US005931155A

United States Patent [19]

Hagner

[11] Patent Number: 5,931,155

[45] Date of Patent: Aug. 3, 1999

[54] OPEN FIREPLACE

[76] Inventor: Mats Hagner, Blåbärsvägen 19, S-902 Umeå, Sweden

[21] Appl. No.: 09/029,216

[22] PCT Filed: Sep. 19, 1996

[86] PCT No.: PCT/SE96/01160

§ 371 Date: Feb. 25, 1998

§ 102(e) Date: Feb. 25, 1998

[87] PCT Pub. No.: WO97/11312

PCT Pub. Date: Mar. 27, 1997

[30] Foreign Application Priority Data

Sep. 19, 1995 [SE] Sweden ..... 9503249

[51] Int. Cl.[6] ..... F24B 1/19; F24B 1/18; F23L 17/04

[52] U.S. Cl. ..... 126/519; 126/307 R

[58] Field of Search ..... 126/519, 59, 515, 126/516, 517, 518, 512, 307 R; 110/195

[56] References Cited

U.S. PATENT DOCUMENTS

| | | |
|---|---|---|
| 2,619,022 | 11/1952 | Hergenrother . |
| 2,818,060 | 12/1957 | Field . |
| 3,244,164 | 4/1966 | Cooper . |
| 3,994,274 | 11/1976 | Manno . |
| 4,167,176 | 9/1979 | Johnson . |
| 4,181,117 | 1/1980 | Hannebaum . |

FOREIGN PATENT DOCUMENTS

| | | | |
|---|---|---|---|
| 2546612 | 11/1984 | France | 126/518 |
| 2 692 969 | 12/1993 | France . | |
| 246635 | 5/1912 | Germany | 126/307 |
| 2 152 206 | 7/1985 | United Kingdom . | |
| 2152206 | 7/1985 | United Kingdom | 126/519 |

*Primary Examiner*—Carl D. Price
*Attorney, Agent, or Firm*—Sughrue, Mion, Zinn, Macpeak & Seas, PLLC

[57] ABSTRACT

An open fireplace which includes a fuel supporting device (16) that enables the fire (10) to be seen from all directions. An essentially vertical smoke duct (7) is disposed so that its bottom orifice (18) will be located above the fuel. The fireplace includes means (13) for delivering cold supply air in the form of an air curtain which surrounds the smoke from the fire (10) and causes the smoke to pass up through the smoke duct (7).

11 Claims, 1 Drawing Sheet

OPEN FIREPLACE

BACKGROUND OF THE INVENTION

The present invention relates to an open fireplace of the kind which includes a fuel-carrying device and which enables the fire to be seen from all directions, and which further includes a generally vertical smoke duct whose bottom orifice is located above the fuel, and an air supply duct.

A fireplace of this general kind is known from GB-A-2,152,206. In the case of this known apparatus, the smoke duct or chimney is terminated with a conically widening canopy. In order to obtain an effective draught in fireplaces of this kind, it is necessary for the distance between the fire and the narrow smoke duct to be short, so that the temperature of the smoke in the chimney will be high. The conical part of the known fireplace introduces a large volume in the lower part of the smoke duct and increases the distance to the narrower part thereof. The temperature of the smoke or combustion gases in the smoke duct will therewith be lower and the draught poorer. In order to compensate for this, it is necessary to reduce the distance between the conical part of the smoke duct and the fire, meaning that not all of the fire will be visible to all occupants of the room. Thus, the comfort aspect essential with this type of fireplace, namely the possibility for all occupants to see the fire, is lost.

Furthermore, in the case of this known fireplace construction the air of combustion is taken from the surrounding room, meaning that the warm air present around the fire will pass out through the smoke duct pipe, or chimney. People sitting around the fire will therefore feel a cold draught coming from behind. The known fireplace construction also has low efficiency with regard to heat economy.

FR-A1-2,692,969 also describes a fireplace construction having a conical canopy which can be raised and lowered. The air of combustion is delivered via the fire grate.

This fireplace construction functions effectively when the conical canopy is lowered and supply air is sucked in via the grate. When the canopy is raised, however, the distance between the inlet orifice of the smoke duct and the supply air duct will be too great to generate a subpressure in the supply air duct. This subpressure namely decreases with the square of the distance. Air of combustion will thus be taken from the surrounding room. The conical fume canopy also introduces a larger volume which lowers the temperature of the smoke and impairs the draught.

SUMMARY OF THE INVENTION

The main object of the present invention is to provide a fireplace which will afford the comfort that is obtained with an open fire, but which will eliminate the aforesaid drawbacks with regard to the risk of smoke spreading into the room and of the heated room air being sucked out through the smoke duct.

The present invention is based on the realization that this object can be achieved by supplying the air of combustion separately and so effectively that essentially no air will be taken from the surrounding room.

In accordance with the present invention, an open fireplace of the kind defined in the first paragraph is mainly characterized in that the air supply duct surrounds the smoke duct and opens out at a location which is so close to the bottom orifice of the smoke duct that the strong subpressure created therein when the fire is alight will be propagated to the air supply duct and therewith contribute in making the delivery of supply air more effective, said supply air being in the form of an air curtain that surrounds the smoke and fumes leaving the fire.

Thus, fuel is combusted in the inventive fireplace in the absence of any appreciable combustion of room air, and smoke and fumes are prevented from penetrating into the room by the surrounding curtain of supply air.

The supply air duct is suitably formed by an outer pipe which surrounds the smoke duct generally concentrically, so as to form therebetween a circumferentially extending shaft through which supply air can be delivered to the fireplace in the form of an air curtain that surrounds the smoke.

In a particularly preferred embodiment of the invention, cold supply air is delivered to the shaft and flows down towards the fire while hot combustion gases flow up through the smoke duct at the same time. This is suitably achieved by extending the outer pipe up through the roof of the building in which the fireplace is installed, so that cold outside air is able to flow down and be used as supply air. Suitable heat insulation is provided between the wall of the smoke duct and cold supply air that flows down in the shaft surrounding the smoke duct.

Other characteristic features of the invention will be apparent from the following claims.

BRIEF DESCRIPTION OF THE DRAWING

The invention will now be described in more detail with reference to an exemplifying embodiment thereof and also with reference to the accompanying drawing.

DETAILED DESCRIPTION OF THE PREFERRED EMBODIMENT

Figure 1:
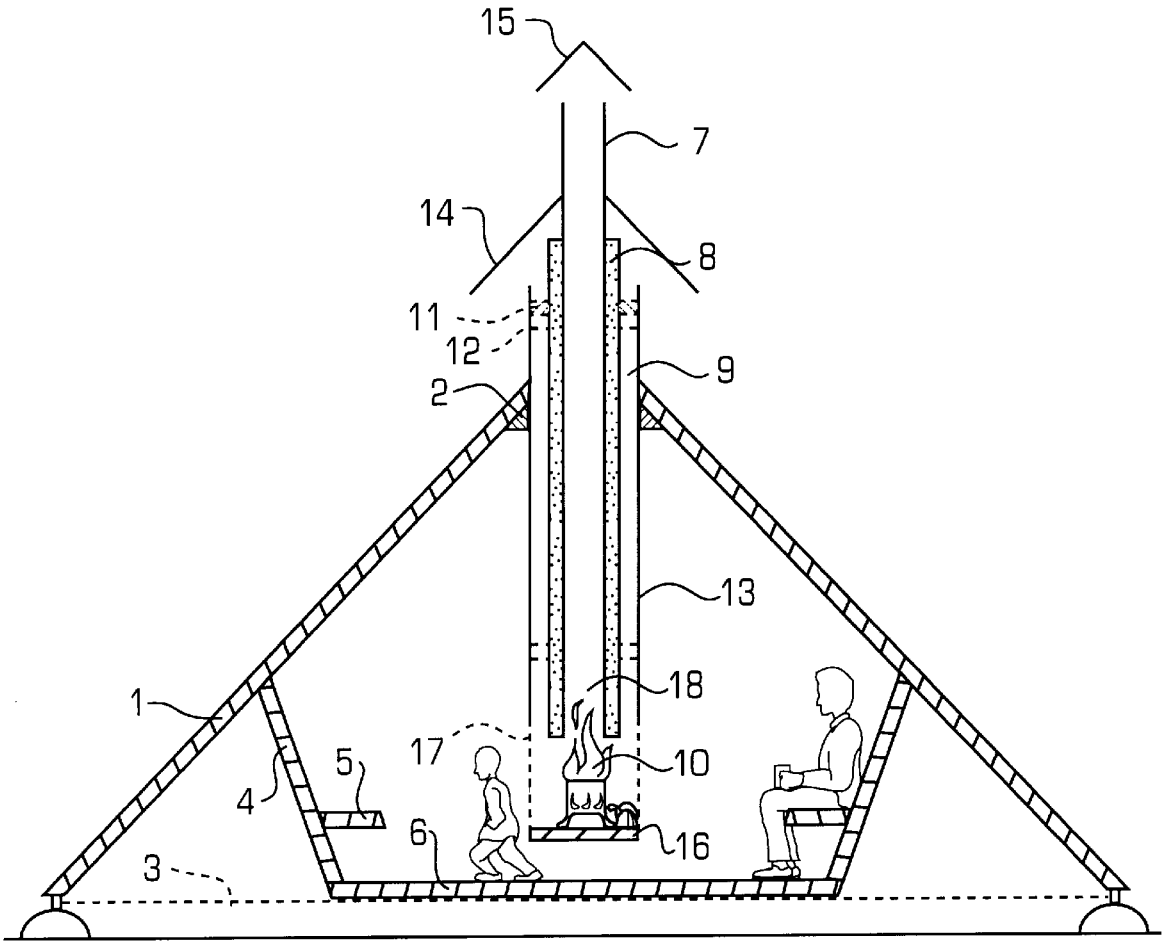

Shown in the drawing is an inventive open fireplace installed in a freely suspended cot or like dwelling hut which is supported by four logs 1, each of which rests on its respective foundation. The logs are positioned at an angle of about 45° to the ground and are mutually supported at their upper ends with the aid of a strong and robust wooden structure 2. So as to prevent the logs from sliding apart, the bottom ends of the logs are mutually connected by a tensioning band 3, e.g. a metal band, such as a wire band, or by a wooden tensioning device. The inner walls 4 of the cot slope so as to form a suitable backrest behind wall-mounted seats 5. The flooring 6 is attached to the logs 1 and is suspended freely above the surface of the ground. Although not shown, a roof made of suitable material is provided between the upper parts of the logs 1.

In the case of the illustrated embodiment, the fireplace includes a plate 16 for supporting fuel which burns to produce the fire 10. The plate 16 is hung from an outer pipe 13 by means of rods 17, or lines, said outer pipe 13 being suspended from the wooden structure 2 so that the upper orifice of the pipe will be located above the top of the cot. The plate 16 can be raised and lowered in relation to the pipe 13 with the aid of hoist means, not shown.

Mounted in the outer pipe 13 is an inner smoke pipe 7 whose bottom end is located vertically above the fire 10 and whose upper orifice is located above the top of the cot and at a higher level than the top orifice of the outer pipe 13. The top orifice of the inner pipe will preferably be located at least 1 m above the top of the cot. Reference numerals 14 and 15 illustrate schematically roof constructions which prevent rain and snow from penetrating into the outer pipe 13 and the smoke pipe 7 respectively.

The smoke pipe 7 is suitably provided with an insulating layer 8 comprised of rock wool or some like material.

Alternatively, an empty heat insulating space may be provided around the smoke pipe 7. The intention is to prevent the hot gases of combustion in the smoke pipe 7 from heating the cold fresh air that is delivered to the fire through the shaft 9 formed between the smoke pipe 7 and the outer pipe 13. Mounted in the shaft 9 are oblique plates 11 or other baffle means which cause the air flowing down through the shaft to move in a helical flow and therewith generate a smooth air flow pattern. The shaft also includes means 12 which function as check valve means for preventing air from flowing up through the shaft 9.

The hoist means for raising and lowering the plate 16 may be constructed to enable the fire hearth to be moved up into the lower part 18 of the smoke pipe. With the hearth in this raised position, oxygen is prevented from reaching the fire in quantities sufficient to sustain the fire and the fire will die out. The construction that includes the outer pipe 13 and the smoke pipe 7 may also be such as to enable said construction to be moved, together with the plate 16, so far up through the roof as to bring the plate 16 level with the ceiling. To prevent the pipes extending too far above the roof, the pipes may be made telescopic, so that they can be telescoped one within the other.

The aforedescribed fireplace functions in the following manner. When the combustion gases from the fire 10 are hot and the distance from the fire to the bottom orifice 18 of the smoke pipe 7 is short, the temperature within the smoke pipe will be high, therewith generating a strong draught. The draught creates a subpressure at the lower end of the smoke pipe which subpressure propagates to the lower end of the shaft 9 and causes an increase of the flow of cold fresh air down through the shaft. Due to its density part of this cold air falls down to the plate 16 where it is sucked in towards the fire 10 and takes part in the combustion of the fuel. The smoke from the fire 10 passes up towards the smoke pipe 7 and is prevented from spreading into the room by means of the curtain of cold air surrounding the fire. The warm air inside the cot is thus not used in the combustion process.

Heat radiating from the fire 10 passes through the surrounding air curtain and warms walls, objects and people present in the cot. The air inside the cot is hereby heated in a manner which provides a warm and draught-free environment.

The distance of the plate 16 from the bottom orifice 18 of the smoke pipe is adjusted in accordance with how well the fire is intended to burn, so as to maintain constantly in the smoke pipe 7 a temperature which will provide a sufficiently strong draught to this end. The check valve means 12 functions to eliminate the risk of smoke flowing up through the pipe 13 and thereby prevent the delivery of supply air to the fire. The use of the oblique plates 11 which produce a circulating air flow through the shaft have been found highly significant in achieving a uniform and stable movement of air in the shaft.

The aforedescribed fireplace operates with a fully natural draught and does not therefore require the use of fans or corresponding devices.

The described arrangement, however, can be varied in several respects within the scope of the following claims. For instance, the plate 16 can be replaced with a basket or like device and may be supported on the floor of the cot instead of being suspended from the chimney structure. The illustrated suspension means, however, enables the height of the fire hearth to be easily adjusted, and the arrangement as a whole can be moved away, by pushing the arrangement up through the roof. It will be understood that the fireplace may also be installed in conventional dwellings, in addition to cots and other small hut-like dwellings. If desiring to concentrate the radiant heat in a given direction, reflecting plates or the like can be placed along parts of the plate 16. These reflective plates may also serve as a fireguard against embers and sparks.

I claim:

1. An open fireplace, comprising:

a) an open sided fuel supporting hearth (16) which enables a fire (10) burning thereon to be seen from all lateral directions, b) a generally vertical smoke duct (7) having a bottom orifice (18) located above the fire, and c) an air supply duct (13) surrounding the smoke duct, defining an air flow passage (9) therewith extending from an outer end exterior of a living space to an inner end within said space, and having a bottom opening disposed in such close vicinity to the bottom orifice of the smoke duct that a subpressure created in the smoke duct as the fire burns is propagated to the air supply duct and therewith contributes to the delivery of external combustion air downwardly through the passage in the form of an air curtain surrounding the fire and smoke therefrom.

2. An open fireplace according to claim 1, wherein the air supply duct is comprised of an outer pipe (13) which surrounds the smoke duct generally concentrically so as to form therebetween a circumferentially extending passage through which combustion air can be delivered to the fireplace.

3. An open fireplace according to claim 2, wherein the outer pipe extends up through a roof of a building in which the fireplace is installed.

4. An open fireplace according to claim 2, further comprising guide means (11) disposed in the passage for producing a downwardly directed, helical flow of combustion air.

5. An open fireplace according to claim 1, wherein the smoke duct comprises a pipe (7) having a generally constant cross-section down to said bottom orifice.

6. An open fireplace according to claim 1, wherein the fuel supporting hearth (16) and the combination of smoke duct and air supply duct can be moved vertically relative to one another to adjust the distance therebetween.

7. An open fireplace according to claim 1, wherein the fuel supporting hearth includes a plate (16) extending sufficiently outwardly to stop the downwardly moving curtain of combustion air at a level with said fire.

8. An open fireplace according to claim 1, wherein the smoke duct and the air supply duct can be pushed up through a roof of a building in which the fireplace is installed.

9. An open fireplace according to claim 8, wherein said ducts are mutually telescopic pipes.

10. An open fireplace, comprising:

a) an open sided fuel supporting hearth (16) which enables a fire (10) burning thereon to be seen from all lateral directions, b) a generally vertical smoke duct (7) having a bottom orifice (18) located above the fire, and c) an air supply duct (13) surrounding the smoke duct, defining an air flow passage (9) therewith extending from an outer end exterior of a living space to an inner end within said space, and having a bottom opening disposed in such close vicinity to the bottom orifice of the smoke duct that a subpressure created in the smoke duct as the fire burns is propagated to the air supply duct and therewith contributes to the delivery of external combustion air downwardly through the passage in the form of an air curtain surrounding the fire and smoke therefrom, d) wherein the air supply duct is comprised of an outer pipe (13) which surrounds the smoke duct generally concentrically so as to form therebetween a circumferentially extending passage through which combustion air can be delivered to the fireplace, and e) further comprising thermal insulation (8) disposed between a wall of the smoke duct and the passage surrounding said smoke duct.

11. An open fireplace, comprising:

a) an open sided fuel supporting hearth (16) which enables a fire (10) burning thereon to be seen from all lateral directions, b) a generally vertical smoke duct (7) having a bottom orifice (18) located above the fire, and c) an air supply duct (13) surrounding the smoke duct, defining an air flow passage (9) therewith extending from an outer end exterior of a living space to an inner end within said space, and having a bottom opening disposed in such close vicinity to the bottom orifice of the smoke duct that a subpressure created in the smoke duct as the fire burns is propagated to the air supply duct and therewith contributes to the delivery of external combustion air downwardly through the passage in the form of an air curtain surrounding the fire and smoke therefrom, d) wherein the air supply duct is comprised of an outer pipe (13) which surrounds the smoke duct generally concentrically so as to form therebetween a circumferentially extending passage through which combustion air can be delivered to the fireplace, and e) wherein the passage includes check valve means (11) for preventing hot combustion gases from passing up through the passage.

* * * * *